US012376656B2

(12) United States Patent
Demeglio

(10) Patent No.: US 12,376,656 B2
(45) Date of Patent: Aug. 5, 2025

(54) ARTICLE OF JEWELRY OR COSTUME JEWELRY COMPRISING A PLURALITY OF ORNAMENTAL ELEMENTS COUPLED TWO BY TWO WITH AT LEAST ONE SHOCK-ABSORBING SPACER ELEMENT ARRANGED THEREBETWEEN

(71) Applicant: ROBERTO DEMEGLIO S.P.A., Turin (IT)

(72) Inventor: Roberto Demeglio, Turin (IT)

(73) Assignee: ROBERTO DEMEGLIO S.P.A., Turin (IT)

( * ) Notice: Subject to any disclaimer, the term of this patent is extended or adjusted under 35 U.S.C. 154(b) by 0 days.

(21) Appl. No.: 18/277,324

(22) PCT Filed: Feb. 24, 2022

(86) PCT No.: PCT/IB2022/051618
§ 371 (c)(1),
(2) Date: Aug. 15, 2023

(87) PCT Pub. No.: WO2022/180556
PCT Pub. Date: Sep. 1, 2022

(65) Prior Publication Data

US 2024/0122314 A1 Apr. 18, 2024

(30) Foreign Application Priority Data

Feb. 25, 2021 (IT) ..... 102021000004385

(51) Int. Cl.
*A44C 5/02* (2006.01)
*A44C 5/00* (2006.01)

(52) U.S. Cl.
CPC ..... *A44C 5/022* (2013.01); *A44C 5/0053* (2013.01); *A44C 5/025* (2013.01)

(58) Field of Classification Search
CPC ..... A44C 5/02; A44C 5/022; A44C 5/025; A44C 5/027; A44C 5/0053; A44C 13/00;
(Continued)

(56) References Cited

U.S. PATENT DOCUMENTS 427,593 A * 5/1890 Mathewson ..... A44C 5/0092 63/3
8,176,751 B2 * 5/2012 Chen ..... A47G 21/02 63/3

(Continued)

FOREIGN PATENT DOCUMENTS

CH 358967 A 12/1961
DE 1008941 B 5/1957

(Continued)

OTHER PUBLICATIONS

International Search Report for International Patent Application No. PCT/IB2022/051618, mailed May 20, 2022.

(Continued)

*Primary Examiner* — Jack W Lavinder
(74) *Attorney, Agent, or Firm* — CANTOR COLBURN LLP

(57) ABSTRACT

An article of jewelry or costume jewelry having at least one elastic or flexible support element and a plurality of ornamental elements fitted in succession on the elastic or flexible support element and coupled two by two along a development direction of the article of jewelry or costume jewelry is provided. Each ornamental element has a first coupling face for coupling to a subsequent contiguous ornamental element, the first coupling face having a raised formation, and an opposite second coupling face for coupling to a previous contiguous ornamental element, the second coupling face having a recess complementary in shape to the raised formation of the previous contiguous ornamental element. Two contiguous ornamental elements are coupled together by accommodating the raised formation of a first element of the two contiguous ornamental elements within the recess of a second element of the two contiguous ornamental elements, with at least one shock-absorbing spacer element arranged therebetween.

11 Claims, 4 Drawing Sheets

(58) Field of Classification Search
CPC .. A44C 15/0045; A44C 15/005; A44C 5/0069
USPC ..... 63/3, 4, 11, 23; 59/79.3
See application file for complete search history.

(56) References Cited

U.S. PATENT DOCUMENTS

| | | | | |
|---|---|---|---|---|
| 10,271,619 | B1 * | 4/2019 | Peck | A44C 5/08 |
| 10,306,957 | B2 * | 6/2019 | Scandolaro | A44C 5/025 |
| 11,116,292 | B2 * | 9/2021 | Demeglio | A44C 11/007 |
| 2011/0095550 | A1 * | 4/2011 | Chen | A47G 21/103 294/218 |
| 2020/0000185 | A1 * | 1/2020 | Demeglio | A44C 11/007 |
| 2023/0371660 | A1 * | 11/2023 | Borsari | A44C 11/007 |

FOREIGN PATENT DOCUMENTS

| | | | |
|---|---|---|---|
| FR | 1108213 | A | 1/1956 |
| IT | TO20110790 | A1 | 12/2011 |

OTHER PUBLICATIONS

Written Opinion for International Patent Application No. PCT/IB2022/051618, mailed May 20, 2022.

* cited by examiner

ARTICLE OF JEWELRY OR COSTUME JEWELRY COMPRISING A PLURALITY OF ORNAMENTAL ELEMENTS COUPLED TWO BY TWO WITH AT LEAST ONE SHOCK-ABSORBING SPACER ELEMENT ARRANGED THEREBETWEEN

CROSS-REFERENCE TO RELATED APPLICATIONS

This application is a National Phase Application of PCT International Application PCT/IB2022/051618, having an International Filing Date of Feb. 24, 2022 which claims priority to Italian Application No. 102021000004385 filed Feb. 25, 2021, each of which is hereby incorporated by reference in its entirety.

FIELD OF THE INVENTION

This invention relates in general to an article of jewelry or costume jewelry such as a bracelet, necklace, earring or ring. More specifically, this invention relates to an article of jewelry or costume jewelry comprising at least one elastic or flexible support element which extends along a direction of development of the article, and a plurality of ornamental elements which are fitted in succession on said support element and coupled two by two along the development direction of the article.

BACKGROUND OF THE INVENTION

Articles of jewelry such as bracelets, necklaces, earrings and rings are known that have a "Tubogas" (gas tube) structure, i.e. are produced by helically extending a form made of metal material, which gives the article high structural elasticity and thus makes it extremely flexible.

An article of jewelry that has a Tubogas structure is obtained by shaping a pair of strips made of metal material so as to have a U-shaped cross section, coupling the two strips longitudinally to one another by interlocking, with one strip upside down with respect to the other, and wrapping the structure obtained in this way in a helical shape around a core in order to give it the desired shape, be it tubular or prismatic.

The Tubogas process therefore produces a continuous link without joints, which gives the article high strength and ductility, as a result of which the article may be adapted to the body of the wearer.

The malleability and flexibility of the metal sheets from which the strips are made and the known techniques for working the metals, in particular precious metals, make it possible to form the metal strips and wrap them in a helical manner, which is what constitutes the Tubogas process.

Disadvantageously, it is not possible to produce this structure using hard and nonmalleable materials such as glass, ceramic or particular polymers.

SUMMARY OF THE INVENTION

An object of this invention is to provide an article of jewelry or costume jewelry which has a structure similar to the well-known Tubogas structure, but which can be produced using non-flexible materials with which it is not possible to use the known techniques for processing and creating the continuous link that characterizes the Tubogas structure.

A further object of the invention is to provide such an article of jewelry or costume jewelry which gives the wearer the same sense in terms of handling, elasticity and acoustic feedback upon handling.

According to the present invention, this object is achieved by an article of jewelry or costume jewelry as described and claimed herein.

Particular embodiments of the present invention are also described.

In summary, this invention is based on the principle of producing an article of jewelry or costume jewelry by fitting a plurality of ornamental elements, such as a plurality of modular ornamental elements, on an elastic supporting core which gives the article flexibility. The plurality of modular ornamental elements, as a result of being coupled in a stacked manner, has a similar aesthetic appearance and handling properties to those of the Tubogas structure.

BRIEF DESCRIPTION OF THE FIGURES

The features and advantages of this invention will be clarified by the detailed description that follows, given purely by way of non-limiting example and with reference to the accompanying drawings, in which.

DETAILED DESCRIPTION

Figure 1:
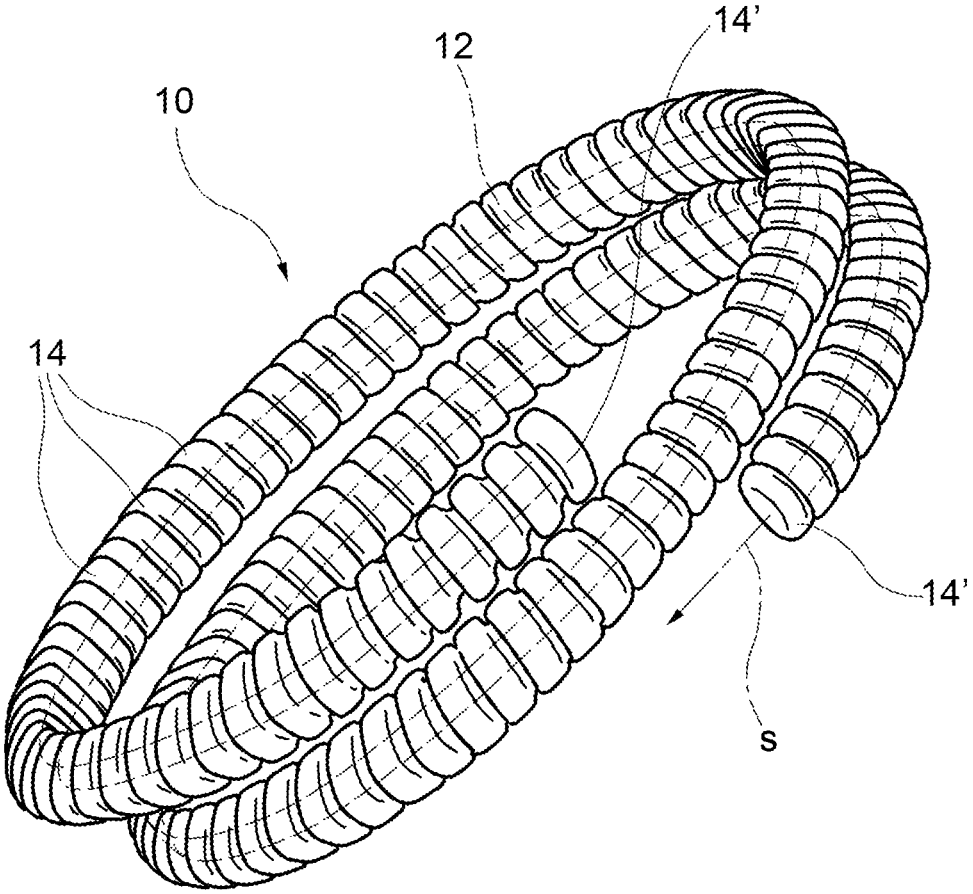
FIG. 1 is a perspective view of a bracelet as an example of an article of jewelry according to this invention.

With initial reference to FIG. 1, an article of jewelry according to an embodiment of this invention is indicated as a whole by reference sign 10. In the embodiment proposed herein, the article of jewelry 10 is a bracelet and, for convenience, will therefore be referred to as a bracelet in the description that follows. Alternatively, the article of jewelry may be a necklace, an earring or a ring. According to a further alternative, the article may be an article of costume jewelry.

The bracelet 10 is shown in FIG. 1 in a condition of normal use, and comprises a plurality of ornamental elements stacked one against the other. In this condition, according to the embodiment shown herein, the bracelet 10 extends along a substantially helical direction s of development (circular, oval and elliptical development directions are also possible).

Fundamentally, the bracelet 10 comprises an elastic or flexible support element 12 (not visible externally, but shown by dashed lines in the figure for better understanding of the invention) which extends along the direction s of development of the bracelet, for example along the entire length of the bracelet, and a plurality of ornamental elements 14 which are threaded in succession onto said support element 12 and non-rigidly coupled two by two along the development direction of the article. An open bracelet, such as the one shown in the figure, also has a pair of end ornamental elements 14' at the free ends of the length thereof.

The support element 12 is preferably formed by a mechanical spring, for example a helical spring, or by a metal sheet or strip, preferably made of titanium, which is adapted to bend around an axis transverse to the development direction of the article. Otherwise, the support element may also be made of polymeric material.

The ornamental elements 14 each have a body which comprises a first face 16 for coupling to a subsequent contiguous ornamental element 14 along the development direction of the article and, on the opposite side, a second face 18 for coupling to a previous contiguous ornamental element 14 along the development direction of the article. The first face 16 of each ornamental element 14 has a raised formation, denoted by 20 in FIGS. 2, 4 and 6, which raised formation is advantageously formed in one piece with the body of the ornamental element, while the second face 18 of each ornamental element 14 has a recess 22 that is complementary in shape to the raised formation of the previous contiguous ornamental element, which recess may be seen in FIGS. 3, 5 and 7. The body may be made of metal material, in particular a precious metal such as gold, or may be made of other non-metal materials, for example glass, ceramic or polymeric material, and may be produced, for example, by machining or by a casting and pressing process.

The ornamental elements 14 are advantageously modular elements which have a generally tapered shape, i.e. a body which comprises a first portion having a larger cross section and a second portion having a smaller cross section, and may be stacked two by two in order for the raised formation thereof to be inserted within the recess of the contiguous element, thus forming connected links of the bracelet. In general, two contiguous ornamental elements are coupled together by accommodating the raised formation 20 of the first element within the complementary recess 22 of the second element, with at least one shock-absorbing spacer element 24 arranged therebetween, as may be seen in each of FIGS. 2 to 7.

The ornamental elements may have different cross-sectional shapes, for example polygonal shapes such as triangular or quadrangular shapes, for example rectangular or cartouche shapes, and may be made of various materials such as metal materials, precious metals, glass, ceramic, or polymeric materials. In the embodiment shown in the figures, the ornamental elements 14 have a smooth surface, but in one alternative embodiment some or all of the ornamental elements may have mounted gems or decorative patterns such as engravings or embossings.

With reference to FIGS. 2 to 7, some embodiments of each ornamental element 14 of the bracelet 10 and of the relative coupling arrangement to the contiguous ornamental elements 14 will be described in detail.

In the embodiment in FIGS. 2 and 3, the body of each ornamental element 14 has a cartouche-shaped cross section, i.e. an elongate or elliptical oval cross section; the raised formation 20 which projects from the first face 16 of the ornamental element, which first face will be described in the following as the front face, also has this shape, and the recess 22 which is formed on the second face 18 of the ornamental element, or rear face of the ornamental element, and which actually constitutes a cavity inside the body of the element, also has this shape.

In this way, the raised formation 20 of the front face of each ornamental element is adapted to positively couple to the recess 22 of the rear face of the contiguous ornamental element, forming a constraint to the translation and mutual rotation of the two elements in a plane transverse to the development direction s of the article.

In the embodiment put forth herein by way of example, the support element 12 is a band made of metal material and the body of each ornamental element has an axial through opening 30 having an area corresponding to the cross-sectional area of the support element, through which said support element extends.

In a variant embodiment, instead of a support element 12, the bracelet may comprise a pair of support elements, i.e. a pair of coplanar bands made of metal material, and the body of each ornamental element has a pair of through openings arranged symmetrically with respect to the development direction of the article, which through openings have an area corresponding to the cross-sectional area of each band, or a single through opening having an area altogether corresponding to the sum of the cross-sectional areas of each band, through which the support elements extend.

Figure 2:
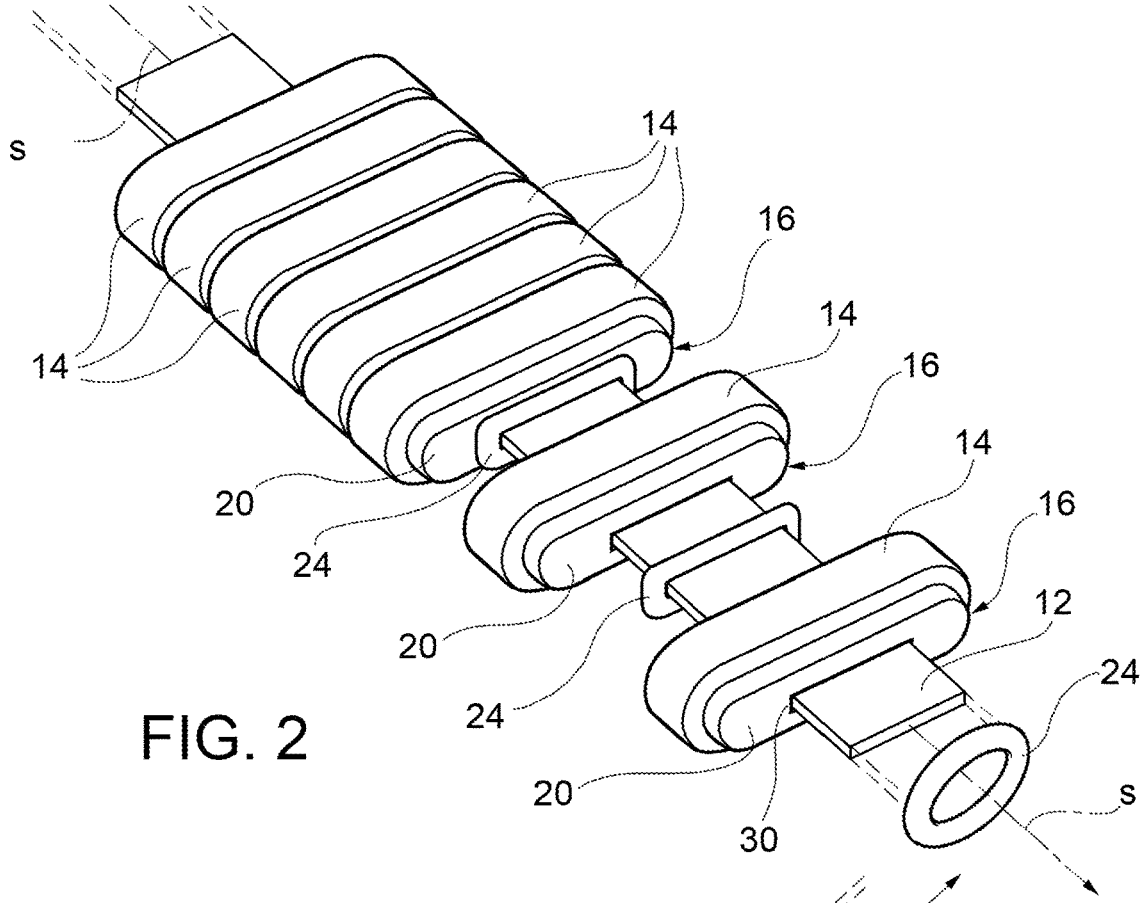
FIG. 2 and FIG. 3 are partially exploded perspective views from the front and from the rear, respectively, of a bracelet segment according to a first embodiment.
Figure 3:
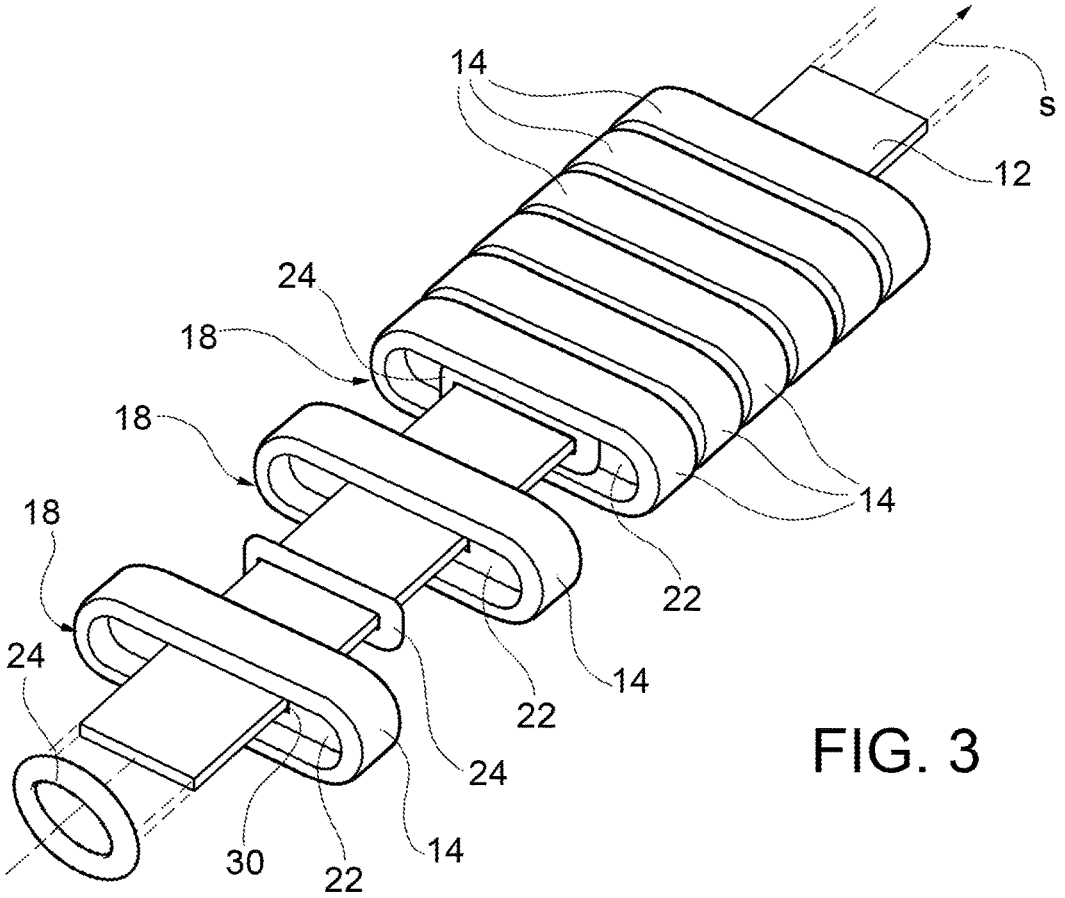

In the embodiment in FIGS. 2 and 3, the shock-absorbing spacer element 24 is an elastomeric ring fitted on the support element 12 between each pair of ornamental elements 14, which ring deforms in such a way as to transversely surround the support element 12. When the ornamental elements are in the stacked condition, the shock-absorbing spacer element 24 abuts on one side against the raised formation 20 and on the other side against the bottom of the recess 22.

Advantageously, mutual movement is allowed between pairs of contiguous ornamental elements, toward and away from one another or bending around an axis transverse to the development direction s of the article, and contact between contiguous elements is softened, thus reducing wear on the elements, and the acoustic effect of this contact is also lessened.

Figure 4:
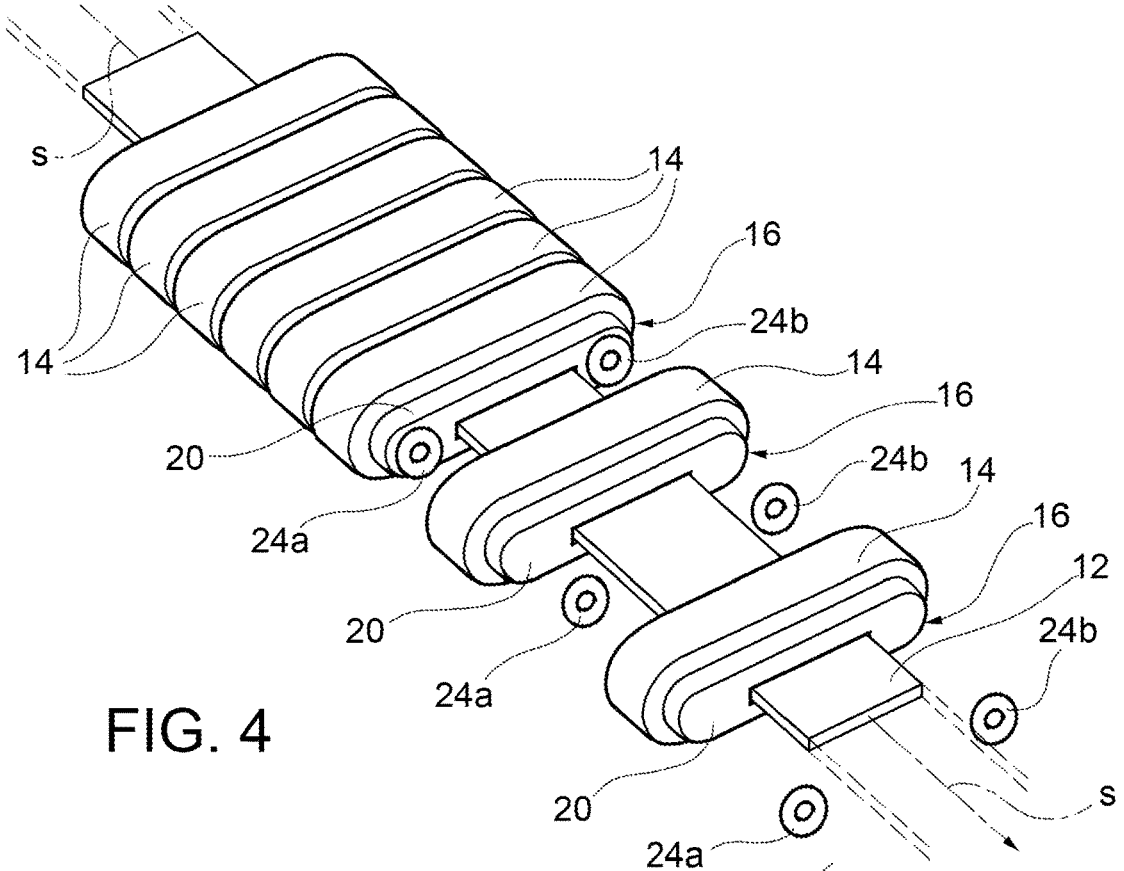
FIG. 4 and FIG. 5 are partially exploded perspective views from the front and from the rear, respectively, of a bracelet segment according to a variant of the first embodiment.
Figure 5:
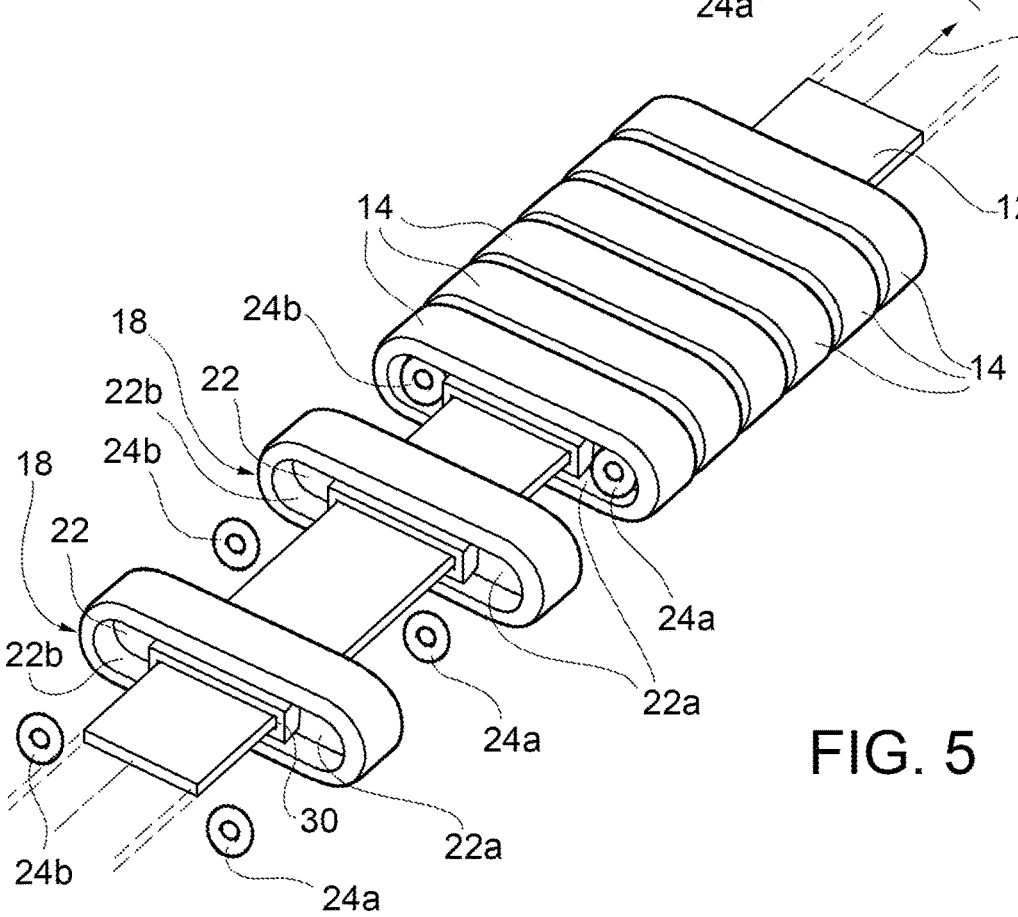

FIGS. 4 and 5 show a variant of the embodiment in FIGS. 2 and 3, but in which, instead of a single shock-absorbing spacer element, two shock-absorbing spacer elements 24*a*, 24*b* are provided in the form of a pair of elastomeric elements arranged on opposite sides of the support element, in respective housing seats 22*a*, 22*b* formed in the recess 22 of the body of each ornamental element.

Figure 6:
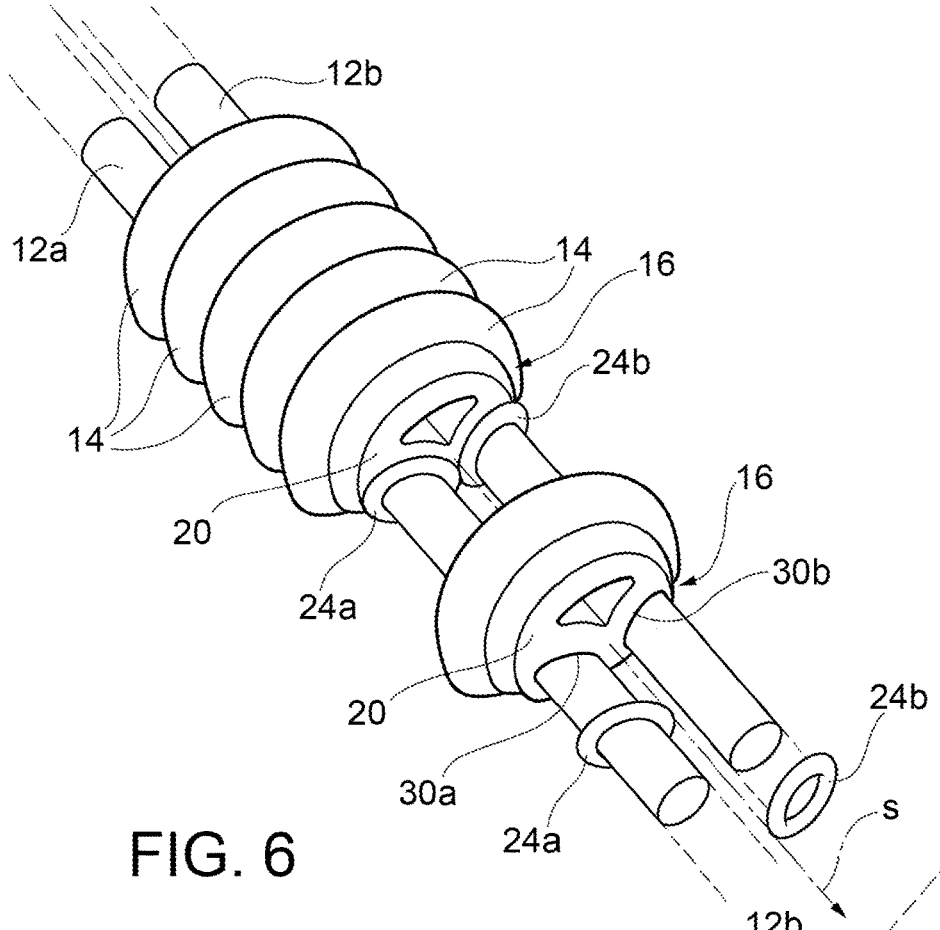
FIG. 6 and FIG. 7 are partially exploded perspective views from the front and from the rear, respectively, of a bracelet segment according to a second embodiment.
Figure 7:
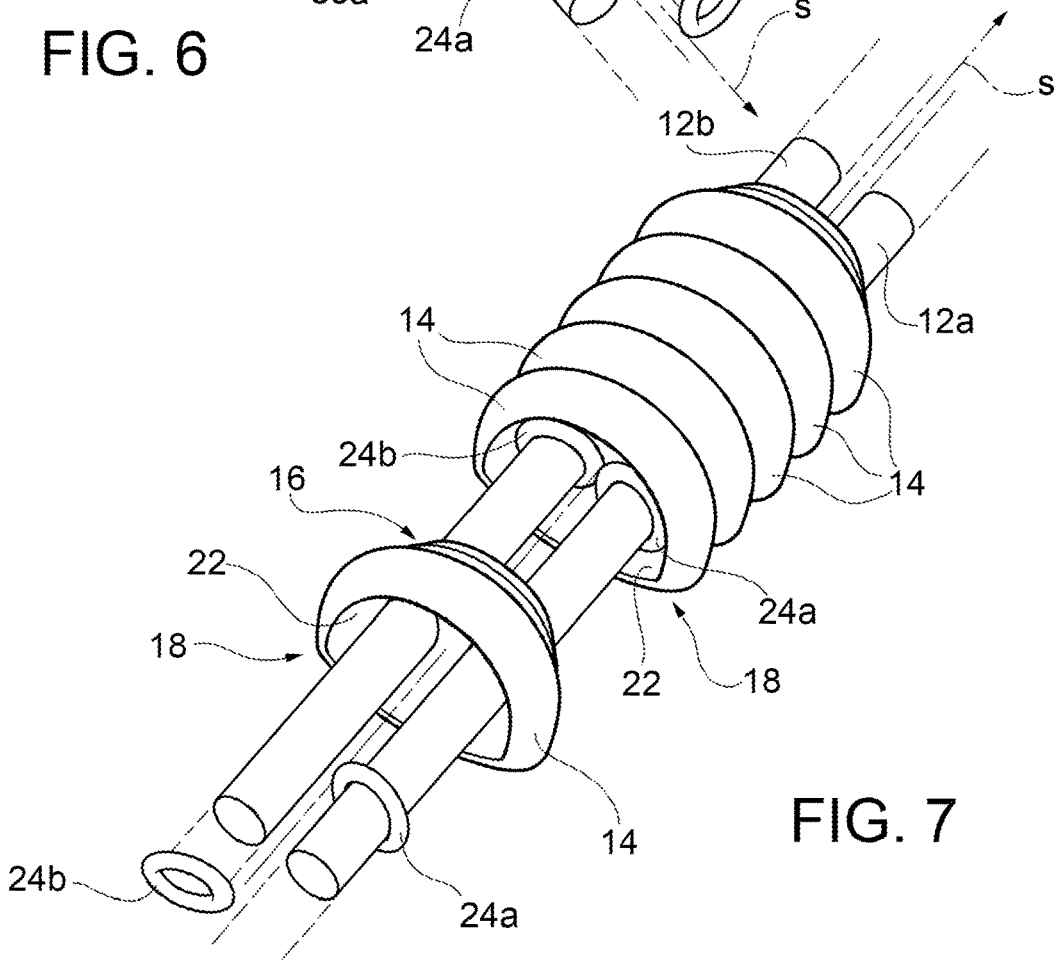

FIGS. 6 and 7 show a second embodiment in which the body of each ornamental element 14 has a convex shape and a cross section whose perimeter is formed by a combination of two circumferential arches having different radii; the raised formation 20 which projects from the first face 16 of the ornamental element, which first face will be described in the following as the front face, also has this shape, and the recess 22 which is formed on the second face 18 of the ornamental element, or rear face of the ornamental element, and which actually constitutes a cavity inside the body of the element, also has this shape.

In this way, the raised formation 20 of the front face of each ornamental element is adapted to positively couple to the recess 22 of the rear face of the contiguous ornamental element, forming a constraint to the mutual translation of the two elements in a plane transverse to the development direction s of the article, while at the same time facilitating the mutual rotation thereof.

The support element 12 may be a band made of metal material or, as shown in the figures, a pair of parallel elastic or flexible support elements which form a constraint to the rotation of each modular ornamental element in a plane transverse to the development direction of the article, for example a pair of parallel helical springs 12*a* and 12*b*. The body of each ornamental element has a pair of through openings 30*a*, 30*b* arranged symmetrically with respect to the development direction s of the article, which through openings have an area corresponding to the cross-sectional area of each helical spring, through which the support elements 12*a* and 12*b* extend, respectively.

Two shock-absorbing spacer elements 24*a*, 24*b* are also provided in this embodiment, in the form of a pair of elastomeric rings fitted on each support helical spring 12*a*, 12*b*.

Advantageously, with the aim of providing the aesthetic impression of a Tubogas structure, the ornamental elements 14 may be arranged so as to be inclined with respect to the development direction, in such a way that the respective coupling faces lie in planes that are not orthogonal to the development direction of the article.

The bracelet 10 may be easily produced by threading the ornamental elements 14 alternately with the spacer element 24 (or with the spacer elements 24*a*, 24*b*) on the support element 12, or by threading the ornamental elements 14 one after the other on the support element 12 while arranging the spacer element or elements therebetween in the respective seats outside the support element.

It should be noted that the embodiment proposed for this invention in the foregoing discussion is purely a non-limiting example of this invention. A person skilled in the art will easily be able to implement this invention in different embodiments which do not however depart from the principles set forth herein and are therefore encompassed in this patent.

This is particularly true with regard to the possibility of producing bracelets for use as watch straps and also of producing belts, handles and shoulder straps for bags.

Of course, without prejudice to the principle of the invention, the embodiments and the details of execution may vary widely with respect to that which has been described and illustrated purely by way of non-limiting example, without thereby departing from the scope of protection of the invention defined by the appended claims.

The invention claimed is:

1. An article of jewelry or costume jewelry, comprising at least one elastic or flexible support element that extends along a development direction of the article of jewelry or costume jewelry, and a plurality of ornamental elements that are fitted in succession on said elastic or flexible support element, each ornamental element being coupled to a next adjacent ornamental element along the development direction of the article of jewelry or costume jewelry, wherein each ornamental element has a body which comprises a first coupling face for coupling to a contiguous ornamental element along the development direction of the article of jewelry or costume jewelry, the first coupling face having a raised formation, and, on an opposite side, a second coupling face for coupling to a previous contiguous ornamental element along the development direction of the article of jewelry or costume jewelry, the second coupling face having a recess that is complementary in shape to the raised formation of the previous contiguous ornamental element, and wherein two contiguous ornamental elements are coupled together by accommodating the raised formation of a first ornamental element of the two contiguous ornamental elements within the recess of a second ornamental element of the two contiguous ornamental elements, with at least one shock-absorbing spacer element arranged therebetween.

2. The article of jewelry or costume jewelry of claim 1, wherein said at least one shock-absorbing spacer element is an elastomeric ring fitted on the elastic or flexible support element.

3. The article of jewelry or costume jewelry of claim 1, comprising a pair of parallel elastic or flexible support elements which form a constraint to rotation of each ornamental element in a plane transverse to the development direction of the article of jewelry or costume jewelry, and a pair of shock-absorbing spacer elements in the form of elastomeric rings fitted on each elastic or flexible support element of said pair of parallel elastic or flexible support elements.

4. The article of jewelry or costume jewelry of claim 3, wherein said pair of parallel elastic or flexible support elements comprises a pair of coplanar bands made of metal or polymeric material and the body of each ornamental element comprises a pair of through openings arranged symmetrically with respect to the development direction of the article of jewelry or costume jewelry, the through openings having an area corresponding to a cross-sectional area of each band, through which the parallel elastic or flexible support elements extend, respectively.

5. The article of jewelry or costume jewelry of claim 3, wherein said pair of parallel elastic or flexible support elements comprises a pair of parallel helical springs made of metal or polymeric material, and the body of each ornamental element comprises a pair of through openings arranged symmetrically with respect to the development direction of the article of jewelry or costume jewelry, the through openings having an area corresponding to a cross-sectional area of each helical spring, through which the parallel elastic or flexible support elements extend, respectively.

6. The article of jewelry or costume jewelry of claim 1, comprising a pair of shock-absorbing spacer elements in the form of a pair of elastomeric elements arranged on opposite sides of the elastic or flexible support element, in respective housing seats formed in the recess of the second coupling face.

7. The article of jewelry or costume jewelry of claim 1, wherein the raised formation of the first coupling face of each ornamental element is adapted to positively couple to the recess of the second coupling face of the contiguous ornamental element, forming a constraint to mutual translation of the two contiguous ornamental elements in a plane transverse to the development direction of the article of jewelry or costume jewelry.

8. The article of jewelry or costume jewelry of claim 1, wherein the raised formation of the first coupling face of each ornamental element is adapted to positively couple to the recess of the second coupling face of the contiguous ornamental element, forming a constraint to translation and mutual rotation of the two contiguous ornamental elements in a plane transverse to the development direction of the article of jewelry or costume jewelry.

9. The article of jewelry or costume jewelry of claim 1, wherein said elastic or flexible support element is a band made of metal or polymeric material and the body of each ornamental element comprises an axial through opening having an area corresponding to a cross-sectional area of said band, through which said elastic or flexible support element extends.

10. The article of jewelry or costume jewelry of claim 1, wherein said raised formation of the first coupling face is formed in one piece with the body of the ornamental element.

11. The article of jewelry or costume jewelry of claim 1, wherein the article of jewelry or costume jewelry is a bracelet, a necklace, an earring or a ring.

* * * * *